US010104481B2

(12) United States Patent
Crook et al.

(10) Patent No.: US 10,104,481 B2
(45) Date of Patent: Oct. 16, 2018

(54) HEARING DEVICE WITH A BATTERY DRAWER

(71) Applicant: Bernafon AG, Berne (CH)

(72) Inventors: Ben Crook, Berne (CH); Pascal Johner, Berne (CH); Roland Margot, Berne (CH); Wilfried Schild, Berne (CH)

(73) Assignee: Bernafon AG, Berne (CH)

( * ) Notice: Subject to any disclaimer, the term of this patent is extended or adjusted under 35 U.S.C. 154(b) by 0 days.

(21) Appl. No.: 15/352,414

(22) Filed: Nov. 15, 2016

(65) Prior Publication Data

US 2017/0142531 A1 May 18, 2017

(30) Foreign Application Priority Data

Nov. 16, 2015 (EP) ..... 15194774

(51) Int. Cl.
*H04R 25/00* (2006.01)

(52) U.S. Cl.
CPC ..... *H04R 25/602* (2013.01); *H04R 25/604* (2013.01); *H04R 2225/021* (2013.01); *H04R 2225/61* (2013.01)

(58) Field of Classification Search
CPC combination set(s) only.
See application file for complete search history.

(56) References Cited

U.S. PATENT DOCUMENTS 3,828,142 A 8/1974 Büttner
5,265,168 A * 11/1993 Schiess ..... H04R 25/608 381/324
9,247,358 B2 * 1/2016 Kristensen ..... H04R 25/602

FOREIGN PATENT DOCUMENTS

DE 10 2010 013 749 A1 4/2011
EP 2 144 456 A1 1/2010
EP 2 779 697 A1 9/2014

* cited by examiner

*Primary Examiner* — Amir Etesam
(74) *Attorney, Agent, or Firm* — Birch, Stewart, Kolasch & Birch, LLP

(57) ABSTRACT

The present disclosure relates to hearing devices having a battery drawer. The present disclosure further relates to hearing devices having a battery drawer for a rechargeable battery or at least the capability to hold a rechargeable battery, however, other types of batteries may also be stored in the battery drawer.

21 Claims, 7 Drawing Sheets

HEARING DEVICE WITH A BATTERY DRAWER

SUMMARY

The present disclosure relates to hearing devices having a battery drawer. The present disclosure further relates to hearing devices having a battery drawer for a rechargeable battery or at least the capability to hold a rechargeable battery, however, other types of batteries may also be stored in the battery drawer.

According to an aspect, a hearing device may comprise a housing being configured to be positioned behind the pinna of a wearer. This housing may hold electronic components, such as an input transducer, an audio processor for processing audio signals from the input transducer, an output transducer for outputting the processed audio signals and a battery device connected to power the electronic components. Some of the electronic components may be passive, i.e. not powered. Usually this is not the case for at least the audio processor. A memory for storing hearing programs may be provided in connection with the audio processor as well as memory for additional purposes.

The battery device may be stored in a battery drawer, which at least partly, when in a closed state, may be flush with a part of the housing. This could provide a smooth surface towards the wearer, as well as hinder the wearer of obtaining easy access to the battery device. This could be particular useful when the battery device is of a type which may be of danger to the wearer or other people not qualified to handle such battery devices such a small children.

The smooth surface of the hearing aid around its entire outer surface may be preferred, when a hearing aid user is wearing the hearing aid, since a smooth surface ensures that objects does not get entangled in the hearing aid surface. Furthermore, a flush battery compartment as disclosed herein also allows for the battery drawer to be arranged, with the side of opening facing the skin of the head when the hearing aid is arranged on the ear. Accordingly, if the hearing aid would be arranged with an element substantially protruding from the surface of the shell of the hearing aid, this would potentially cause irritation to the skin of a user, why a flush surface is preferred. Therefore, by the battery to be flush with a part of the housing, it should be understood that there is not irregularities, such as protruding gripping parts or other element, which protrudes from the surface of the hearing aid shell, making the surface of the hearing aid substantially smooth along the outer contours thereof.

In addition, a smooth surface may also be a preferred solution for rechargeable hearing aids, since such hearing aids may be configured to be arranged in a charger station without having to move the battery from the hearing aid. Accordingly, a flush surface may create more suitable charging possibilities for a rechargeable hearing aid.

The hearing aid disclosed herein is preferably intended as a rechargeable hearing aid, why a gripping part, which is usually arranged to allow a fully opening of the battery drawer for removal of the battery, not needed. The locking mechanism as described throughout the disclosure eliminates the need for a gripping part.

The hearing device may include the battery drawer being configured to pivot at a battery pivot point when moving from the closed state to an open state. This will provide access to the battery device when the battery drawer is in the open state.

If the battery drawer is firmly connected to the housing at the pivot point, it is ensured that the battery drawer is not detached from the housing while replacing the battery device. In the hearing device, the battery drawer may have a lock mechanism ensuring that the battery drawer is maintained in the closed state until operated to an unlock state. This will ensure that the battery drawer is not unintentionally opened by e.g. the wearer or someone not qualified to open it.

In the hearing device, the housing may include an opening configured to receive a key device to operate the lock mechanism from the locked state to an unlock state thereby allowing the battery drawer to change from the closed state to the open state. This opening may have any suitable shape.

The lock mechanism may include a body being forced against an inner part of the housing by a spring element and wherein during opening the key device push the body in a direction so as to compress the spring element. This is contemplated to further reduce the risk of the battery drawer being opened unintentionally.

Furthermore, the construction of the lock mechanism aids in locking of the battery drawer when in a closed position thereof, but also assist in the opening action of the battery drawer. That is, the lock mechanism is constructed with a body having a surface that interacts with a key element in such a manner that upon interacting on the surface of the body by the key element, the body compresses the spring element, and further the key acts on the surface of the body with a downward directed force, which in combination with the compression of the spring allows the body to loosen the grip with a part of the housing to enter an open position of the battery drawer. Accordingly, this allows for a secure and reliable lock mechanism, which may be opened only by a suitable force applied through a key element to the surface of the body element, whereby the body releases the grip with the housing. It would be advantageous if the key device could include a pin-shaped end configured to engage the lock mechanism. This could reduce the risk of a non-qualified person uses e.g. a pen or other device to attempt to open the battery drawer.

In the hearing device, a battery spring may be used to engage the battery device when the battery drawer is in the closed state so as to establish electrical connection between the battery device and the electronic components. Further to this, when the battery spring is loaded by contact to the battery device, the battery spring could exert a force that takes part in the change from the closed state to the open state of the battery drawer, e.g. push the battery drawer away from the housing and thereby, at least help with, causing it to open.

The body in the lock mechanism may include a surface defining an angle relative to the spring element, and wherein the key device is configured to engage the surface. This angle could also help ensure that there is sufficient force to cause the battery drawer to change from the closed to the open state, e.g. as at least part of the force exerted from the key device could be translated into the outward motion of the battery drawer. The angle could be in the range 5 to 85 degrees, such as 25 to 65 degrees, such as 40 to 50 degrees, such as around 45 degrees, such as 45 degrees. Specific angles depend on the shape and form of the housing, as well as the position of the battery drawer in the housing.

The battery drawer may include a seal so as to provide a fluid or liquid seal towards the external environment. This could be useful if it is desired that the hearing device should be at least water resistant or even water and/or liquid and/or fluid proof.

It could be that the battery device is a lithium-based battery device. This would also entail that the hearing device included charging circuitry for providing a charge current to the battery device.

The opening in the housing may include an indicator device for visually indicating to the wearer if the hearing device is intended for wearing on/at the left or right ear. This could be e.g. blue/red colored material where at least an end-surface of the indicator device is visible to the wearer when the indicator device is mounted in the housing.

The indicator device may include an opening configured for receiving the key device. This could help reduce the number of mechanical elements in the housing. The opening in the indicator device could be formed at the interface to the housing or near the center of the visible part of the indicator device. The opening could be positioned so that the lock mechanism have a surface perpendicular to the opening, this would mean that the key device, having e.g. a pin-shaped part, would be guided to exert a force at least roughly perpendicular to the surface.

The hearing device may be provided with a key device which is formed as an integrated part of an opening in the housing. That is the key device is arranged in the housing so as to be an operable part of the housing shell. The key device may therefore extend partly out of the opening in the housing so as to form a button which a person may act press in order to activate the lock mechanism. In this way an additional tool is not necessary to open the battery drawer, instead the button of the key device may be pushed in order to release the locking mechanism of the battery drawer.

The input device could include a single microphone or a microphone array or wherein one microphone is intended to be placed at the ear canal of the wearer and one or more microphones are in the housing. When using more than one microphone, e.g. more than one omnidirectional microphone, a directional signal may be established e.g. by combining the signals from several omnidirectional microphones.

BRIEF DESCRIPTION OF DRAWINGS

The embodiments of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each embodiment may each be combined with any or all features of the other aspects. These and other embodiments, features and/or technical effects will be apparent from and elucidated with reference to the illustrations described hereinafter in which:

DETAILED DESCRIPTION

Figure 1:
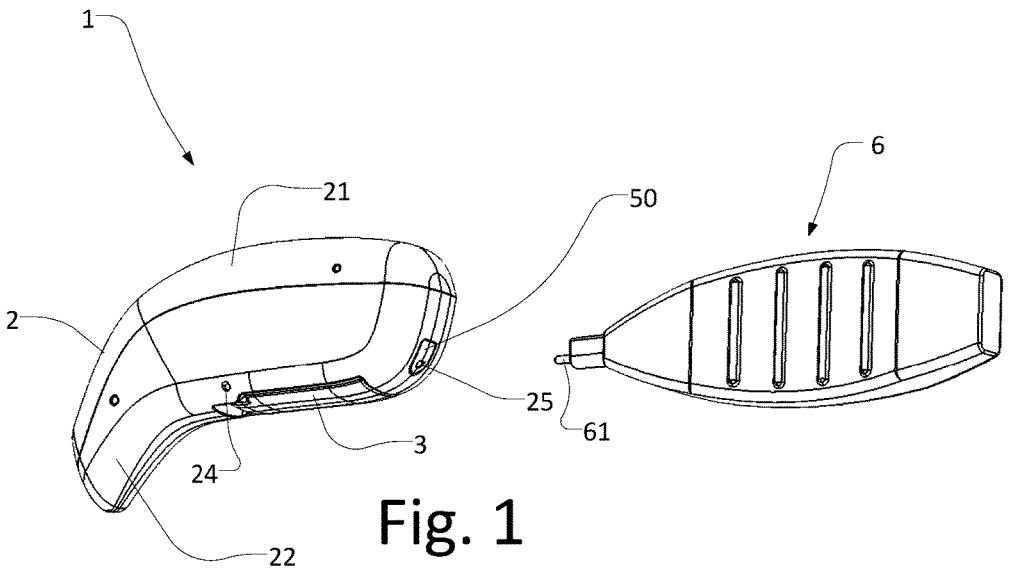
FIG. 1 illustrates a side view of a hearing device and a key device according to an embodiment of the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several embodiments of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn at least one of two ways, including i) arranging a unit of the hearing device behind the ear with a tube leading air-borne acoustic signals into the ear canal or ii) with a receiver/loudspeaker arranged close to or in the ear canal such as in a Behind-the-Ear type hearing aid.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefitting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal.

Now referring to FIG. 1 a hearing device 1 and a key device 6 according to an embodiment of the disclosure is illustrated. The hearing device 1 comprises a housing 2, which in a state of use is configured to be positioned behind the pinna of the wearer. The housing 2 is configured to hold electronic components including an input transducer, an audio processor for processing audio signals from the input transducer, an output transducer for outputting the processed audio signals (not shown). The audio processor is adapted to process the incoming sound so as to compensate for the wearers specific hearing loss, e.g. by amplification, frequency transpositioning etc. Further, other suitable processing may be performed, e.g. feedback monitoring, tinnitus treatment, logging of environment and/or performance and/or settings.

Figure 2:
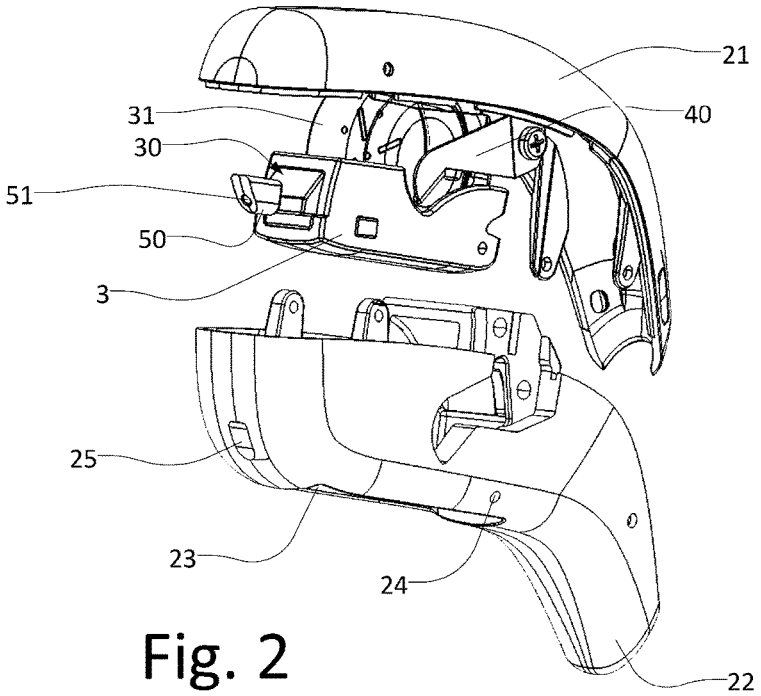
FIG. 2 illustrates a partly exploded side view of a hearing device according to an embodiment of the disclosure.

In addition, illustrated in FIG. 2, a battery device 31 is arranged in the housing 2 and is configured to supply power to the electronic components. The battery device 31 may be replaced, however it is preferred that this is not to be performed by the wearer.

Figure 4:
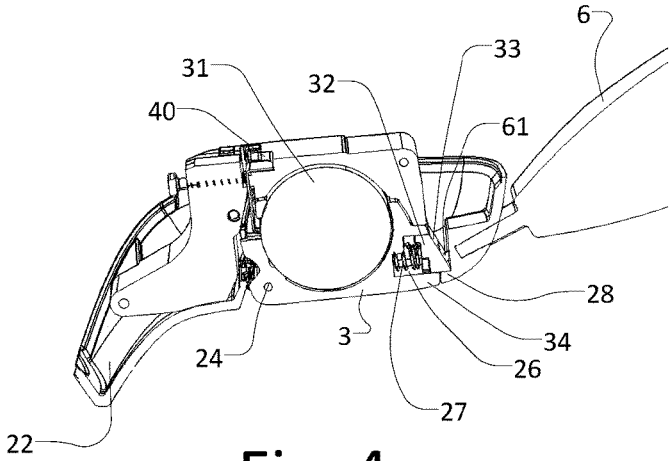
FIG. 4 illustrates a cross-sectional side view of a hearing device according to FIG. 3.

In more detail, illustrated in e.g. FIGS. 2 and 4, the housing comprises a top shell 21 and a bottom shell 22. As seen from FIGS. 1 and 2, the top 21 and bottom 22 shell in an assembled condition form the hearing device housing 2.

With reference to FIGS. 1 and 2, is it seen that the bottom shell 22 comprises an opening 23, where the opening 23 is configured to receive a battery drawer 3. The opening 23 is arranged in a bottom part of the bottom shell 22, why it may in the following be contemplated as a bottom opening 23 in the bottom shell 22. The battery drawer 3 is further configured to hold the battery device 31, so as to store the battery device 31 in the battery drawer 3. The battery drawer 3 is arranged in the bottom shell 22 in connection with a battery pivot point 24 around which the battery drawer 3 is arranged to pivot in order to allow for access to, e.g. for replacement of the battery device 31, when moving from a closed state to an open state of the battery drawer 3. The battery drawer 3 is arranged in the bottom shell 22 in such a way that the battery drawer 3 in a closed state is flush with a part, i.e. the bottom shell 22 of the housing 2.

In addition, illustrated in FIG. 2, the battery drawer 3 comprises a lock mechanism 30, which ensures that the battery drawer is maintained in the closed state until operated to an unlocked state, in which unlocked state the battery drawer 3 pops out from the bottom shell 22 allowing removal of the battery device 31.

Furthermore, the housing 2 includes a key opening 25 configured to receive the key device 6 to operate the lock mechanism 30 from the locked state to the unlocked state thereby allowing the battery drawer 31 to change from the closed position to the open position.

Figure 3:
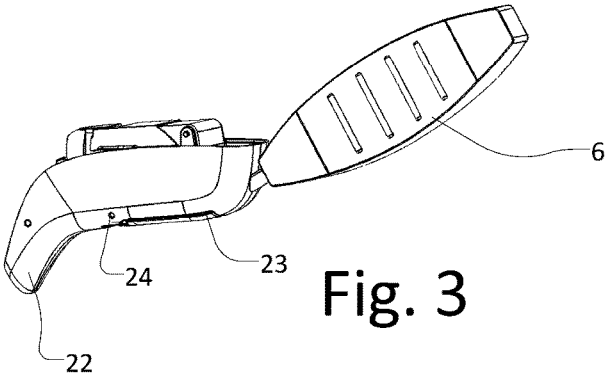
FIG. 3 illustrates a hearing device according to an embodiment of the disclosure in a locked state of the battery drawer.
Figure 5:
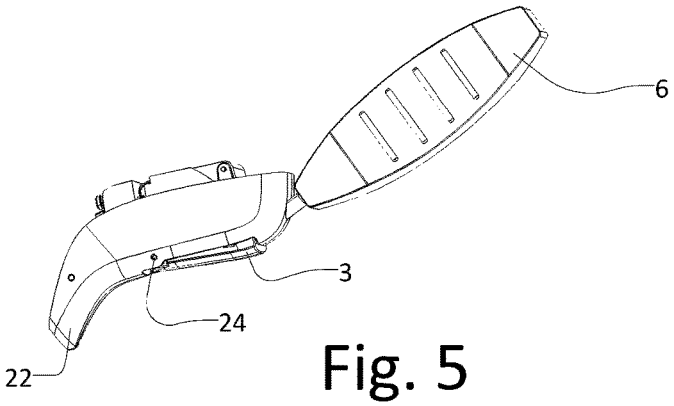
FIG. 5 illustrates a hearing device according to FIG. 3, where the battery drawer is in an unlocked state.

The function of the lock mechanism 30 of the battery drawer 3 is explained in more detail with e.g. reference to FIGS. 3 to 5. When a person, most likely a hearing care professional, intends to change the battery device 31 of the hearing device 1 (i.e. a hearing aid) a key device 6 is used to open the battery drawer 3. An end 61 of the key device 6 is pushed into the key opening 25 of the housing 2 of the hearing device 1. The insertion of the key device 6 interacts with a body 32 of the lock mechanism 30. Upon insertion of the end 61 of the key device 6 into the opening 25, the body 32 is forced towards an inner part 26 of the housing 2 and acts on a spring element 27, owing to the shape of the receptacle in the battery drawer holding the body 32 and the spring element 27. The key device 6 during opening thus pushes the body 32 in a direction so as to compress the spring element 27, allowing the body 32 to move from a locked position to an unlocked position, where the battery drawer 3 loosens the grip with a side part 28 of the bottom opening 23 in the bottom shell 22. This allows the battery drawer to pivot around the battery pivot point 24 so as to make an end 34 of the battery drawer 3 visible and operable beneath the outer sides of the bottom shell 22.

In summary, the insertion of the end 61 of the key device 6 exerts a force on body 32, whereby the spring element 27 is compressed, and the body is moved a position so as to allow for the battery drawer 3 to open as illustrated in FIG. 5. Thus, coming from the closed position (i.e. the locked state) of the battery drawer 3 illustrated in FIG. 3 to the open position (i.e. the unlocked state) of the battery drawer 3 is achieved by the insertion of the end 61 of the key device 6 into the key opening 25 in the hearing aid housing 2.

As seen in FIG. 5 this unlocking of the battery drawer 3 causes the battery drawer 3 to click out of the bottom shell 22 of the housing 2, whereby a user and/or hearing care professional is allowed access to the battery drawer 3 for removal and/or insertion of a battery device 31. The opening of the battery drawer allowing removal of the battery is thereby only achieved by use of an operable tool, i.e. the key device, mating with the opening 25 and the lock mechanism. This ensures that unintentional opening of the battery drawer does not occur easily or accidentally.

Figure 10:
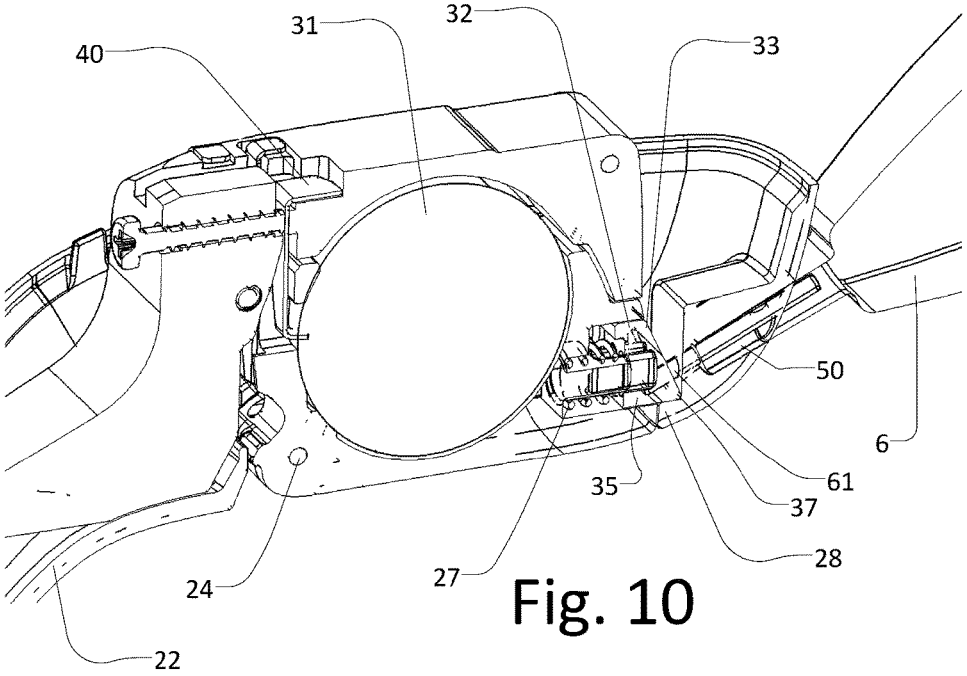
FIG. 10 illustrates a cross sectional side view of a hearing device according to the disclosure.

As illustrated in FIGS. 1 and 10, the key device 6 includes a pin-shaped end 61, which engages the lock mechanism 30. The pin-shaped end 61 may be formed so as to compliment/match the shape of the insertion opening 25 in the housing. In this way, it could be ensured that only the intended operable key device can be used for opening the battery drawer.

Figure 6:
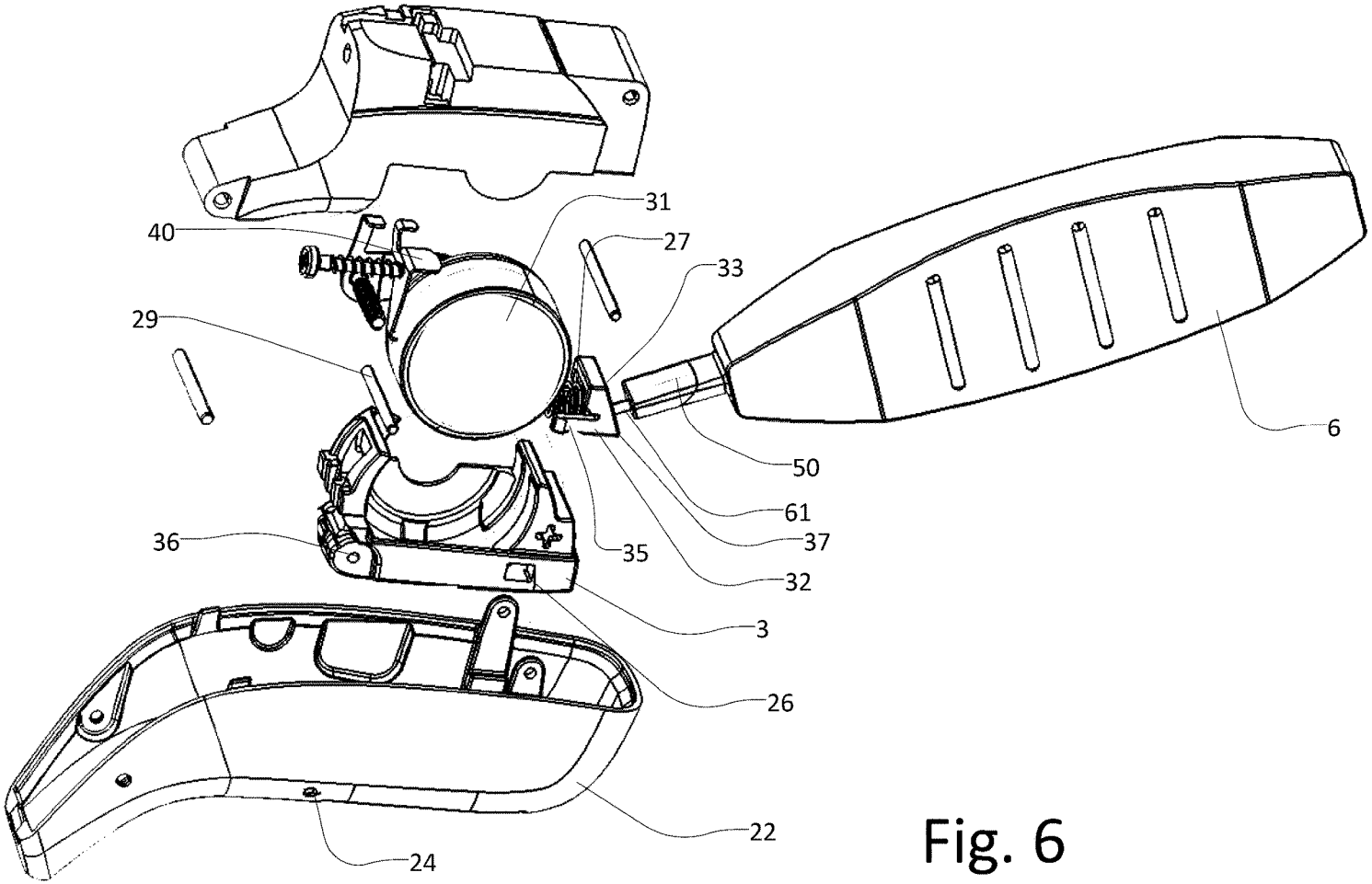
FIG. 6 illustrates an exploded side view of a hearing device according to the disclosure.
Figure 7:
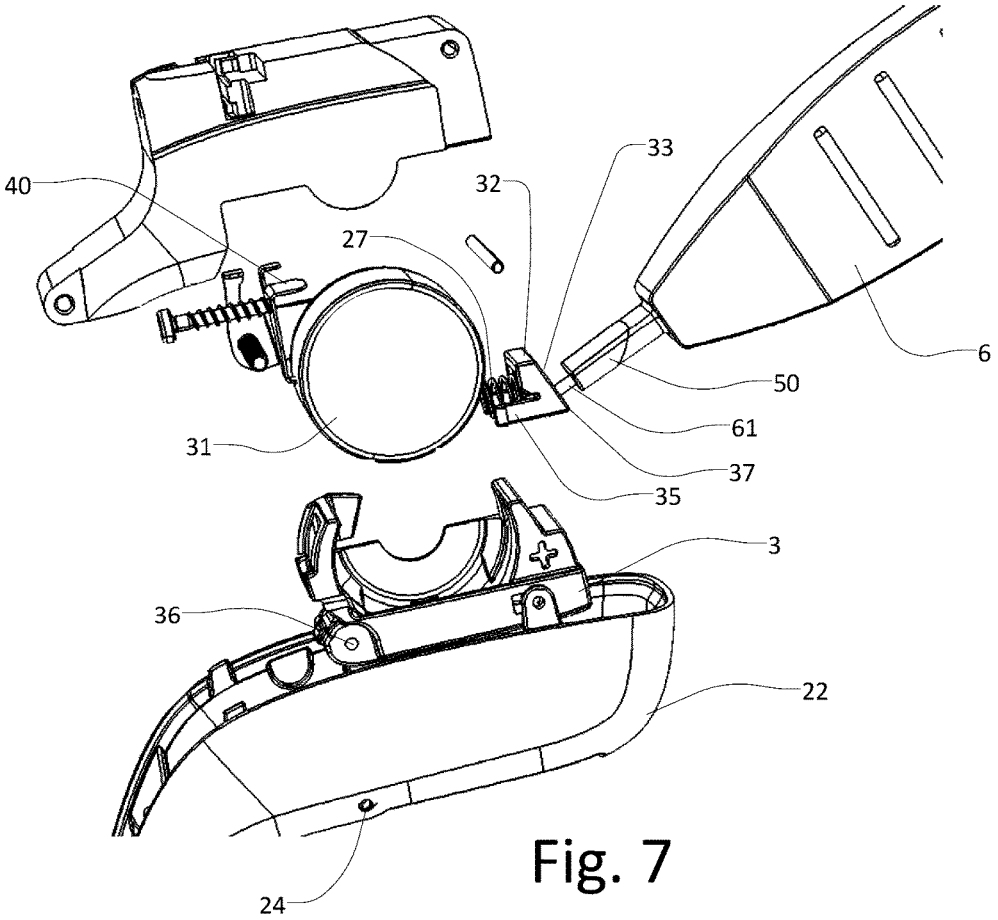
FIG. 7 illustrates a zoomed exploded side view of a hearing device according to the disclosure.

The key device 6, is further configured to exert a force on the lock mechanism 30 of the battery drawer 3. As illustrated in e.g. FIGS. 6 and 7, the body 32 includes a surface 33 defining an angle relative to the spring element 27. The spring element 27 defines a spring axis along which the spring element 27 compresses when loaded. Upon insertion of the end 61 of the key device 6, the end 61 of the key device exerts a force on the surface 33. In turn, the body 32 exert a force to the spring element 27 which, if the force is sufficient, compresses along the spring axis. In the embodiment illustrated, the plane of the surface 33 defines an angle with the spring axis of the spring element 27. In addition, it is seen that the surface 33 also defines an angle with a longitudinal direction of the pin-shaped end 61 of the key device 6. When the key device 6 is placed into the opening 25 of the housing 2, the angle between the surface 33 and the longitudinal direction of the pin-shaped end 61, creates a downward directed force against the surface 33 of the battery drawer. At the same time a force from the push on the body 32 acts on the spring element 27 forcing the body 32 to move from a closed position to an open position. Thus the combined forces on the surface 33 of the body 32 causes a corner 37 (see e.g. FIG. 10) of the body 32 to move in a direction away from the side part 28 and downwards, resulting in the release (i.e. unlocking) of the battery drawer.

The angle defined by the surface 33 and the spring element 27, is preferably in the range 5 to 85 degrees, such as 25 to 65 degrees, such as 40 to 50 degrees, such as around 45 degrees, such as 45 degrees. In the figures, the angle is approximately 45 degrees. Similarly, the angle defined by the surface 33 and a longitudinal direction of the end 61 of the key device 6, is in the range 5 to 85 degrees, such as 25 to 65 degrees, such as 40 to 50 degrees, such as around 45 degrees, such as 45 degrees. Also here the angle in the figures is approximately 45 degrees.

Figure 8:
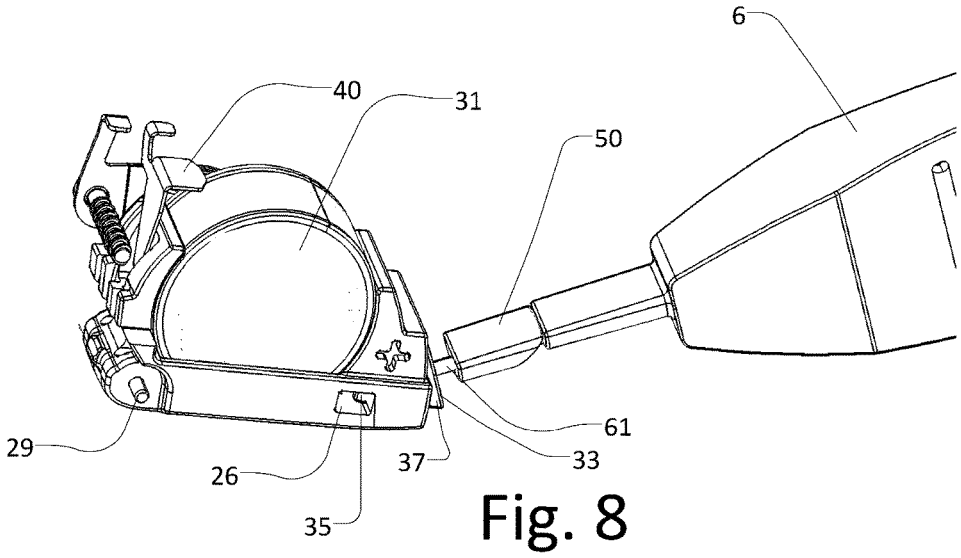
FIG. 8 illustrates a side view of a battery drawer system of a hearing device according to the disclosure.

In a closed state of the battery drawer, such as illustrated in FIG. 10, the body 32 is shaped so as to comprise at least one flange 35, which extends from the surface 33 in a direction perpendicular to the surface 33, so as to bridge the opening 23 in the bottom shell. By this configuration, the flange 35 of the body 32 extends into an inner part 26 of the battery drawer, as illustrated in FIGS. 8 and 10. The flange part 35 together with the angled configuration of the surface 33 thus creates a bridging effect of the battery drawer 3 with the side part 28 of the bottom shell 22. As seen on the partly exploded view of the battery drawer in FIG. 8, the body 32 has a part (i.e. the corner 37) that in an assembled condition extends partly out of the battery drawer 3. This corner 37 (also defined as an edge of the body) ensures that, when the spring element 27 is not influenced by a force from the insertion of the key device, the spring element 27 forces the corner 37 towards the side part 28 of the bottom shell 22 so as to keep the battery drawer in a locked state.

Figure 9:
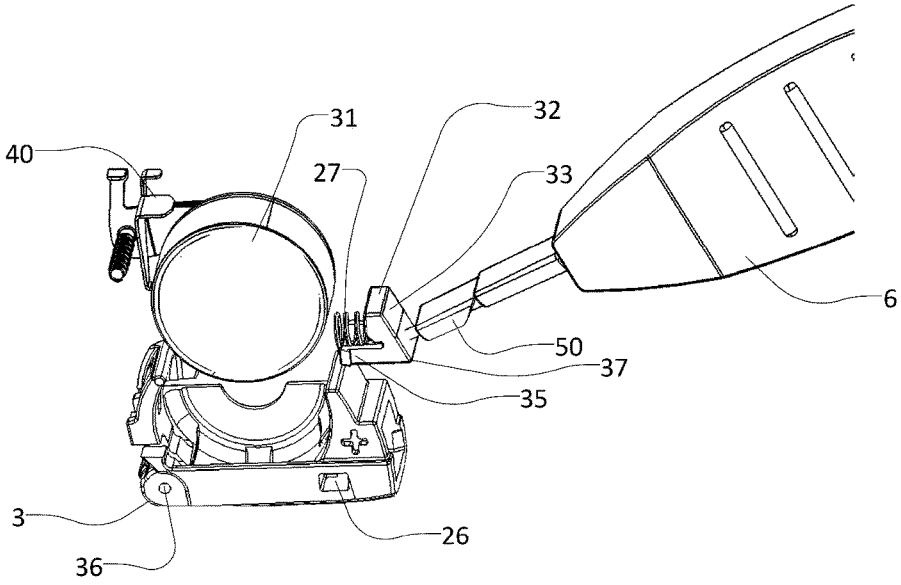
FIG. 9 illustrates an exploded side view of a battery drawer system according to FIG. 8.

For the pivoting movement of the battery drawer between the locked and unlocked state, the housing is configured with a battery pivot point 24, which is located at one end of an opening in the bottom shell 22 of the housing 2. The battery pivot point 24 as illustrated in the exploded views of FIGS. 6 to 7, receives a pivot pin 29 which is connected to the battery drawer 3 through a pivot hole 36. As seen on FIGS. 8 and 9, the pivot pin 29 in an assembled condition is inserted through the pivot hole 36, and is connected with the pivot point 24 in the housing 2. During opening of the battery drawer 3, the battery drawer 3 thus pivots in the pivot point 24 around pivot pin 29.

As seen in e.g. FIGS. 2 and 8, a battery spring 40 engages the battery device when the battery drawer 3 is in the closed state so as to establish electrical connection between the battery device and the electronic components. The battery spring 40 exerts a force on a plane side of the battery device and on a rounded side of the battery device 31. Thus, the battery spring is further loaded by contact to the battery device 31 in an assembled state, as the battery springs exerts a force opposite to the spring element 27 of the lock mechanism. The activation of the lock mechanism therefore also influences the battery springs with forces acting in a direction towards the spring element 27, resulting in the battery spring 40 exerting a force that takes part in the change from the closed state to the open state of the battery drawer 3.

Figure 11:
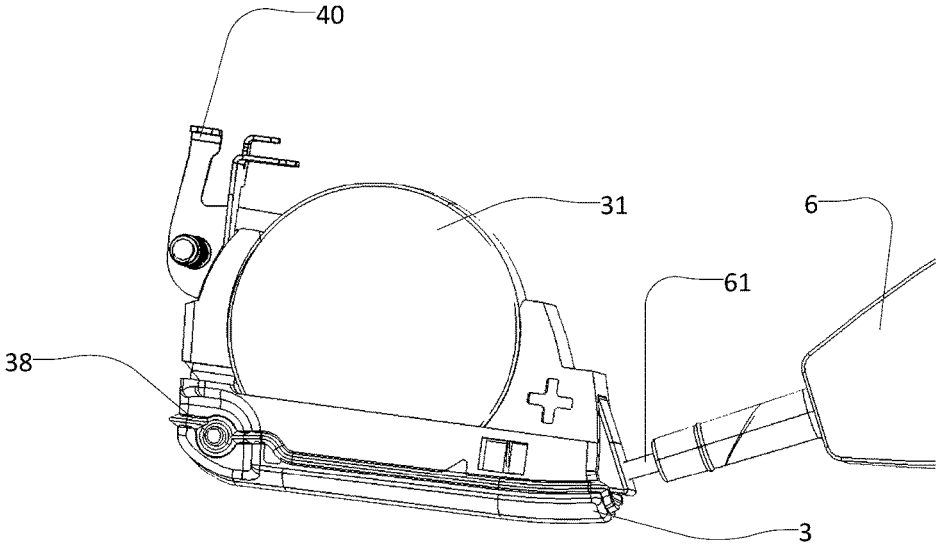
FIG. 11 illustrates an embodiment of the disclosure, having a sealing element FIG. 12 illustrated another embodiment of the hearing device according to the disclosure.

In an embodiment of the disclosure illustrated in FIG. 11, the battery drawer 3 includes a seal 38, so as to provide a fluid or liquid seal towards the external environment. The seal element 38 is in the embodiment shown provided on outer sides of the battery drawer 3 so as to seal against inner side of the bottom shell of the housing.

Additionally, the battery device is a lithium-based battery device.

The insertion opening 25 in the housing may include an indicator element 50 for visually indicating to the wearer if the hearing device is intended for wearing on/at the left or right ear. The indicator element (i.e. indicator device) is arranged in the opening 25 of the housing 2 so as to fill out the opening 25. Thus, the indicator device 50 may be formed in the shape of the opening 25 in the housing. For allowing insertion of the key device 6 the indicator device 50 therefore also includes an opening 51, configured for receiving the key device. In addition, the opening 51 in the indicator device may be formed at the interface to the housing or near the center of the visible part of the indicator device, the latter being the opening at the reference numeral 51 in FIG. 2, the other not illustrated directly in the figures. The indicator device 50 is inserted into the opening 25 so as to be flushed with the surface of the housing 2, allowing a smooth finish of the housing surface.

In general, the opening 25 could be positioned so that the lock mechanism 30 have a surface 33 perpendicular to the opening. This means that the key device 6 with the end 61 would be guided to exert a force at least roughly perpendicular to the surface 33 of the body 32.

Figure 12:
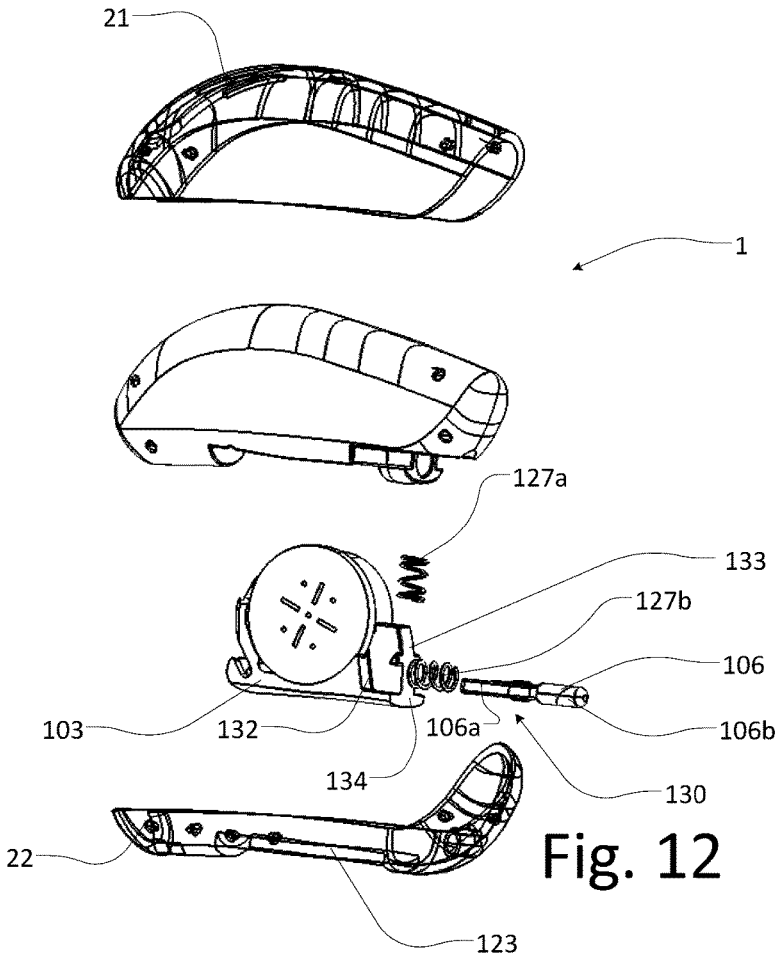
Figure 13:
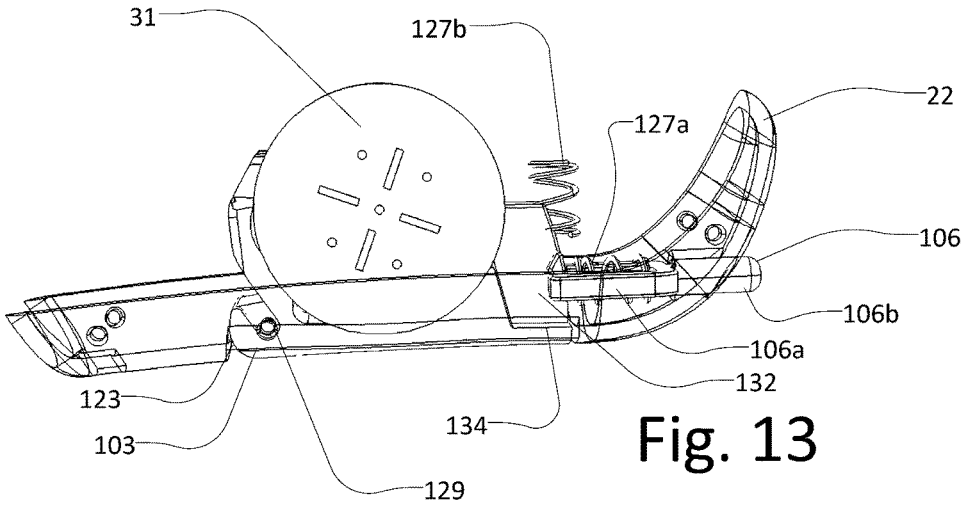
FIG. 13 illustrates an embodiment of the hearing device according to FIG. 12.

Alternatively, illustrated in FIGS. 12 and 13, the key device 106 may be an incorporated part of the hearing device 1. The hearing device 1 comprises in similar manner as previously described a housing 2, having a bottom shell 22 and a top shell 21. In this embodiment, the key device 106 is an integrated part of the opening of the housing, the opening corresponding to the previously described opening 25. The key device 106 is thus an incorporated part of the hearing device and has substantially the function of button, which should be pressed to activate the lock mechanism 130 of the battery drawer 103. In order to activate the lock mechanism 130, the key device 106 is pushed in a direction substantially parallel with a longitudinal direction of the housing and towards the interior of the housing, i.e. towards the battery device 31. In this embodiment, an angle between the spring element 127*b* and a surface 133 of the lock mechanism 130 is approximately 90 degrees. The function of the lock mechanism 130, includes a first spring element 127*b* and a second spring element 127*a*. The first spring 127*b* and second spring 127*a* is configured to act on the surface 133 of the lock mechanism from two directions perpendicular to each other. One spring 127*a* is arranged in the housing so as to create a downward force acting on the battery drawer 103, whereas the second spring 127*a*, perpendicular to the first spring 127*b* is arranged to exert a force perpendicular to the downward force. The net result of the forces causes the body 132 of the lock mechanism to move in a direction away from the opening where the key device 106 is inserted and downwards. This allows an end part 134 to loosen from the bottom opening in the bottom shell 22. At the same time, the spring element 127*a* creates a downwards directed force which forces the battery drawer 103 to move in a direction downwards. This two-part forced movement of the lock mechanism 130 of the battery drawer result in an opening of the battery drawer by a pivotal movement of the battery drawer 3 around pivot pin 129.

In FIGS. 12 and 13, the key device 106 could be configured as a two-part device, with a first part 106*a* being arranged (i.e. incorporated) in the housing so as to connect with the spring 127*b*, whereas the second part 106*b* could be a detachable part of the key device 106. That is the second part 106*b* could be configured such as to be an external "pin" device used to be inserted into the opening 25 upon a desired removal and/or insertion of a battery device 31 in the battery drawer 103. In this way, the alternative embodiment of FIGS. 12 and 13 may also be understood to cover a solution, where an external device is used to activate the lock mechanism.

Other possible configurations of forces acting on the body causing it to "click-open" and stay in a locked state in a closed position would be apparent for a person skilled in the art.

With regards to the previously described embodiment, the e key device, could be an external key device operable by a user and/or a hearing care professional, or as described in the embodiment it could be an operable mechanism build into the housing of the hearing aid. This could for example be a button element which should be pressed in order to activate the un-locking of the battery drawer.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the embodiments shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing device, comprising:

a housing being configured to be positioned behind the pinna of a wearer, the housing holding electronic components including an input transducer, an audio processor for processing audio signals from the input transducer, an output transducer for outputting the processed audio signals, a battery device connected to power the electronic components, wherein the battery device is stored in a battery drawer, where when in a closed state the battery drawer is flush with a part of the housing, so as to form a smooth surface of the hearing device, and the battery drawer is configured to pivot at a battery pivot point when moving from the closed state to an open state, the battery drawer further having a lock mechanism ensuring that the battery drawer is maintained in the closed state until operated to an unlocked state, wherein the housing includes an opening configured to receive a key device to operate the lock mechanism from the locked state to the unlocked state thereby allowing the battery drawer to change from the closed state to the open state, wherein the lock mechanism includes a body being forced against an inner part of the housing by a spring element in a closed state of the hearing device, without the body and the spring element being formed as an integral unit, and wherein the body is configured so that, during opening, the body is pushed into the spring element in a direction of a spring axis of the spring element so as to compress the spring element.

2. The hearing device according to claim 1, wherein the body comprises a surface defining an angle relative to said spring axis of the spring element, wherein the key device upon insertion thereof exerts a force on said surface of said body forcing the spring element to compress along the spring axis and further creating a downward directed force on said surface.

3. The hearing device according to claim 1, wherein the key device includes a pin-shaped end configured to engage the lock mechanism.

4. The hearing device according to claim 1, wherein a battery spring engages the battery device when the battery drawer is in the closed state so as to establish electrical connection between the battery device and the electronic components, and wherein when the battery spring is loaded by contact to the battery device, the battery spring exert a force that takes part in the change from the closed state to the open state of the battery drawer.

5. The hearing device according to claim 1, wherein the body in the key device includes a surface defining an angle relative to the spring element, and wherein the key device is configured to engage the surface defining the angle.

6. The hearing device according to claim 5, wherein the angle is in the range 5 to 85 degrees.

7. The hearing device according to claim 1, wherein the battery drawer includes a seal so as to provide a fluid or liquid seal towards the external environment.

8. The hearing device according to claim 1, wherein the battery device is a lithium-based battery device.

9. A hearing device, comprising:

a housing being configured to be positioned behind the pinna of a wearer, the housing holding electronic components including an input transducer, an audio processor for processing audio signals from the input transducer, an output transducer for outputting the processed audio signals, a battery device connected to power the electronic components, and wherein the battery device is stored in a battery drawer, where when in a closed state the battery drawer is flush with a part of the housing, so as to form a smooth surface of the hearing device, and the battery drawer is configured to pivot at a battery pivot point when moving from the closed state to an open state, the battery drawer further having a lock mechanism ensuring that the battery drawer is maintained in the closed state until operated to an unlocked state, wherein the housing includes an opening configured to receive a key device to operate the lock mechanism from the locked state to the unlocked state thereby allowing the battery drawer to change from the closed state to the open state, wherein the lock mechanism includes a body being forced against an inner part of the housing by a spring element in a closed state of the hearing device and wherein during opening the key device pushes the body in a direction so as to compress the spring element along a spring axis thereof, wherein the opening in the housing includes an indicator device for visually indicating to the wearer if the hearing device is intended for wearing on/at the left or right ear.

10. The hearing device according to claim 9, wherein the indicator device include an opening configured for receiving the key device.

11. The hearing device according to claim 10, wherein the opening in the indicator device is formed at the interface to the housing or near the center of the visible part of the indicator device.

12. The hearing device according to claim 1, wherein the input device is a single microphone or a microphone array or wherein one microphone is intended to be placed at the ear canal of the wearer and one or more microphones are in the housing.

13. A hearing device, comprising:

a housing being configured to be positioned behind the pinna of a wearer, the housing holding electronic components including an input transducer, an audio processor for processing audio signals from the input transducer, an output transducer for outputting the processed audio signals, a battery device connected to power the electronic components, and wherein the battery device is stored in a battery drawer, where when in a closed state the battery drawer is flush with a part of the housing, so as to form a smooth surface of the hearing device, and the battery drawer is configured to pivot at a battery pivot point when moving from the closed state to an open state, the battery drawer further having a lock mechanism ensuring that the battery drawer is maintained in the closed state until operated to an unlocked state, wherein the housing includes an opening configured to receive a key device to operate the lock mechanism from the locked state to the unlocked state thereby allowing the battery drawer to change from the closed state to the open state, wherein the lock mechanism includes a body being forced against an inner part of the housing by a spring element in a closed state of the hearing device and wherein during opening the key device pushes the body in a direction so as to compress the spring element along a spring axis thereof, and wherein at least a part of the key device forms an integrated part of an opening in the housing.

14. The hearing device according to claim 13, wherein at least a part of the key device extends partly out of the opening in the housing so as to form a button which is pressed in order to activate the lock mechanism.

15. The hearing device according to claim 2, wherein the key device includes a pin-shaped end configured to engage the lock mechanism.

16. The hearing device according to claim 2, wherein a battery spring engages the battery device when the battery drawer is in the closed state so as to establish electrical connection between the battery device and the electronic components, and wherein when the battery spring is loaded by contact to the battery device, the battery spring exert a force that takes part in the change from the closed state to the open state of the battery drawer.

17. The hearing device according to claim 3, wherein a battery spring engages the battery device when the battery drawer is in the closed state so as to establish electrical connection between the battery device and the electronic components, and wherein when the battery spring is loaded by contact to the battery device, the battery spring exert a force that takes part in the change from the closed state to the open state of the battery drawer.

18. The hearing device according to claim 2, wherein the body in the key device includes a surface defining an angle relative to the spring element, and wherein the key device is configured to engage the surface.

19. The hearing device according to claim 3, wherein the body in the key device includes a surface defining an angle relative to the spring element, and wherein the key device is configured to engage the surface.

20. The hearing device according to claim 4, wherein the body in the key device includes a surface defining an angle relative to the spring element, and wherein the key device is configured to engage the surface.

21. The hearing device according to claim 1, wherein the hearing device is a hearing aid.

* * * * *